United States Patent [19]

McGuire et al.

[11] Patent Number: 4,771,166

[45] Date of Patent: Sep. 13, 1988

[54] ELECTRIC FURNACE HEATER MOUNTING

[75] Inventors: Dane T. McGuire, San Dimas; John K. Grier, Walnut; Harold M. Bone, Glendora, all of Calif.; Suresh C. Jhawar, Huntingdon Valley, Pa.; Michael T. Mercer, Norco, Calif.

[73] Assignee: Grier-McGuire, Inc., City of Industry, Calif.

[21] Appl. No.: 82,049

[22] Filed: Aug. 5, 1987

[51] Int. Cl.[4] ..... H05B 3/06

[52] U.S. Cl. ..... 219/532; 219/552; 338/316

[58] Field of Search ..... 219/532, 537, 542, 552; 338/321, 315, 316, 317, 318, 319, 320

[56] References Cited

U.S. PATENT DOCUMENTS 3,737,553 6/1973 Kreider ..... 373/130
3,798,417 3/1974 Bittner ..... 338/316 X
3,812,276 5/1979 Cyrway ..... 373/128
4,056,678 6/1981 Bea II ..... 373/130

*Primary Examiner*—Clifford C. Shaw
*Assistant Examiner*—M. M. Lateef
*Attorney, Agent, or Firm*—Christie, Parker & Hale

[57] ABSTRACT

A vacuum furnace has a heating chamber heated by metal strip electric heater elements. The elements have insulated mechanical support between their ends to hold them in position in the furnace. Support is provided by assemblies having spaced apart mounting assemblies with a rigid bridge compliantly mounted therebetween. The heater strip is compliantly connected to the bridge. Each mounting assembly has a metal post connected to the furnace heating chamber and surrounded by a ceramic sleeve. The ceramic sleeve is surrounded by two ceramic tubes which hold an end of the bridge therebetween.

17 Claims, 2 Drawing Sheets

ELECTRIC FURNACE HEATER MOUNTING

FIELD OF THE INVENTION

This invention relates to mounting of electric strip heating elements in high temperature, vacuum or protective atmosphere furnaces.

BACKGROUND

Electric heating elements in high temperature vacuum furnaces are often made of strips of sheet molybdenum or the like. Electrical contact may be made to the ends of a long metal strip which wraps around the hearth of the furnace. Such a long heating element requires mechanical support intermittently along its length to hold it in proper position in the furnace and for preventing shorting to other parts of the furnace or the load being heated in the furnace. Various techniques for providing insulated mechanical support for such a heater element have been employed, but none are completely satisfactory. Less than satisfactory heating element supports are described and illustrated in U.S. Pat. Nos. 3,737,553 by Kreider, 3,812,276 by Cyrway and 4,056,678 by Beall.

Some heater supports have relied on an insulated post, or the like, extending through a hole in the strip heater. Although good mechanical support can be provided with such an arrangement, the hole is quite undesirable. The hole necessarily results in the heater having a narrower effective width at the location of the hole. Since there is less metal cross-section to carry the heating current, there is excess heating around the hole. This excess heating can be severe enough to burn out a heater under some circumstances and, if nothing else, it shortens the heater lifetime in that region. Heater elements most commonly fail at the end electrical contacts or in proximity to such holes.

Another type of heater support that does not require holes through the heater element is in a general form of a T. A sheet metal "post" forms the leg of the T, and the heater element lies on top of the top crossbar of the T. The heater element is secured to the crossbar by a rod lying on top of the heater element with twisted wires securing the bar to the crossbar of the T. Ceramic sleeves insulate the crossbar from the leg of the T to provide a compliant connection. Supports shown in the Kreider and Cyrway patents are of this general type.

Such heater supports have been plagued with deformation problems. There is insufficient rigidity in the T-shaped mounting to support the heater element as it tries to move under the forces of thermal expansion, cooling gas flow, mechanical vibrations, and the like. The crossbar of the T tends to tilt relative to the leg, which may result in shorting of the heater element to other parts of the furnace structure or the load in the furnace. Breakage is also a problem when attempting to remove or replace the heater element supports. In high-temperature furnaces, heater elements, heat-shields and supports for the heater elements are often made of molybdenum. This material becomes quite brittle after heating to elevated temperatures.

It is also important to provide good electrical insulation between the heater element and other portions of the furnace. This electrical insulation must not only isolate the heater element when the furnace is first put into service, but must also maintain such isolation after heating. A problem encountered in high-temperature vacuum furnaces is "metallizing." Components of the furnace and articles being heated in the furnace may evolve metal vapors that deposit on electrical insulators and provide an electrically conductive path which shorts such a heater element to other parts of the furnace. The electrical insulation should resist such shorting when metallizing occurs.

The heater support must also accommodate dimensional changes in the heater and the furnace. Typically, one part of the support is at relatively low temperature, while another part is at relatively high temperature. The heater element itself undergoes thermal expansion as it is heated. The consequent dimensional changes must be accommodated by the support without applying large mechanical loads on the brittle heating element, which could result in breakage.

It is also desirable to minimize the number of parts in a support assembly and to have as many parts as possible simply cut from stock materials without expensive machining or forming operations.

BRIEF SUMMARY OF THE INVENTION

To address such problems, there is provided in practice of this invention according to a presently preferred embodiment, a mechanical support for an electric heating element in a vacuum furnace or the like which is a pair of spaced-apart mounting assemblies with a rigid bridge therebetween. The bridge is electrically insulated from any metal parts of the mounting assemblies and is sufficiently compliantly connected thereto to accommodate thermal expansion of the bridge without substantial deformation. The heater strip is compliantly secured to the bridge without holes in the strip. An exemplary mounting assembly is a metal post with a ceramic sleeve surrounding the metal post and a pair of ceramic tubes around the sleeve with an end of the bridge held between the tubes.

DRAWINGS

These and other features and advantages of the present invention will be apparent from the following detailed description when considered in connection with the accompanying drawings wherein.

DESCRIPTION

Figure 1:
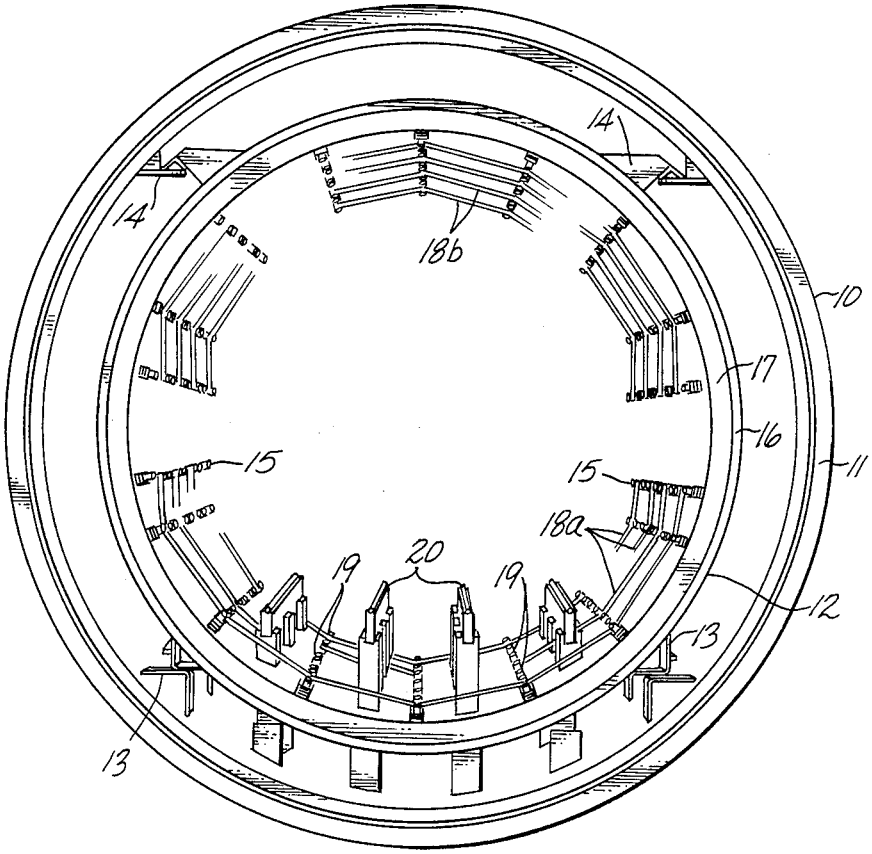
FIG. 1 is an end perspective view into a vacuum furnace.

An exemplary vacuum furnace comprises a horizontal cylindrical shell 10 having a sealing flange 11 at the end, against which a door (not shown) is sealed to close the furnace. The furnace illustrated in FIG. 1 is schematic and does not include a variety of conventional features such as support legs, doors, vacuum pumps, water cooling jackets, gauges, power supplies, etc., which are not required for an understanding of this invention. The drawing simply shows the general location of the heater elements and their supports employed in practice of this invention.

In the exemplary furnace, there is a horizontal cylindrical hot zone 12 suspended away from the furnace shell by lower support brackets 13 and upper support brackets 14. Minimal cross-section supports are employed for minimizing heat transfer from the heating chamber to the water-cooled furnace shell. In a typical embodiment, the hot zone comprises a double walled sheet metal plenum 16 into which cooling gas can be circulated for rapid cooling of the hot zone and its contents. Inwardly from the plenum is a layer (or layers) of thermal insulation 17 which may be in the form of a plurality of parallel metal radiation shields, fibrous ceramic insulating "wool", graphite "wool", or ceramic or graphite insulating sheets. Regardless of the insulation employed in the hot zone, the innermost face is typically formed of sheet metal or flexible graphite sheet (Grafoil) which may be bonded to other materials. Such thermal insulation is conventional and need not be further described for an understanding of this invention.

A plurality of electrical heating elements 18 extend circumferentially around the interior of the hot zone. In the embodiment illustrated, there are a plurality of lower heating elements 18*a*, each of which extends around approximately half of the circumference of the hot zone. Similar upper heating elements 18*b* extend around the upper half of the hot zone. Each heating element has conventional bolted electrical contacts 15 at each end for passing electric current through the heating element. Each heating element is mechanically supported between its ends by a plurality of supporting assemblies 18 illustrated in greater detail in FIG. 2.

A plurality of furnace load supporting structures 20 extend from the furnace shell between the heater elements into the hot zone. Baskets of parts (not shown) or other objects to be heated are placed on such supporting structures when the furnace is in use.

It will be recognized that the exemplary furnace is just one of many possible embodiments. Such a furnace may have a vertical cylindrical shell or be rectangular or have any desired shape or size. It may be a bottom loading or top loading furnace instead of the end loading furnace as illustrated. On a smaller diameter furnace, the electrical heating elements may extend substantially completely around the circumference of the hot zone. On larger furnaces, heating elements may extend less than half way around the hot zone. Continuous strip heating elements may be used which make repeated paths around the furnace or which are connected for three phase power. Mounting assemblies may also be used for supporting intermediate portions of sinusoidal heating elements which traverse longitudinally through the furnace shell. They may also be used for supporting parts of flat heating elements in rectangular furnaces. Many other variations and modifications of electric vacuum furnaces or the like in which this invention may be employed will be apparent. The invention is also described in connection with a vacuum furnace, however it will be apparent that it is equally applicable in protective atmosphere furnaces, or in furnaces operated in air when oxidation resistant materials are employed.

To give an order of magnitude, a furnace such as illustrated in FIG. 1 may have a hot zone with a five foot diameter. Supports for the heating elements are spaced in the order of one foot apart around the hot zone. Typical molybdenum heating elements are from 2½ to 6 inches wide. Four or more such heating elements are spaced along the length of the hearth, depending on its total length. Such heating elements are generally not a continuous semi-circle, but instead are formed as a plurality of straight sections between adjacent support assemblies, with a small straight section adjacent to each support assembly. Small angle bends are sufficient to form such a heating element for an exemplary five foot diameter furnace. Such bends are readily made on a break and avoid the need for rolls for rolling a continuously curved heating element.

Figure 2:
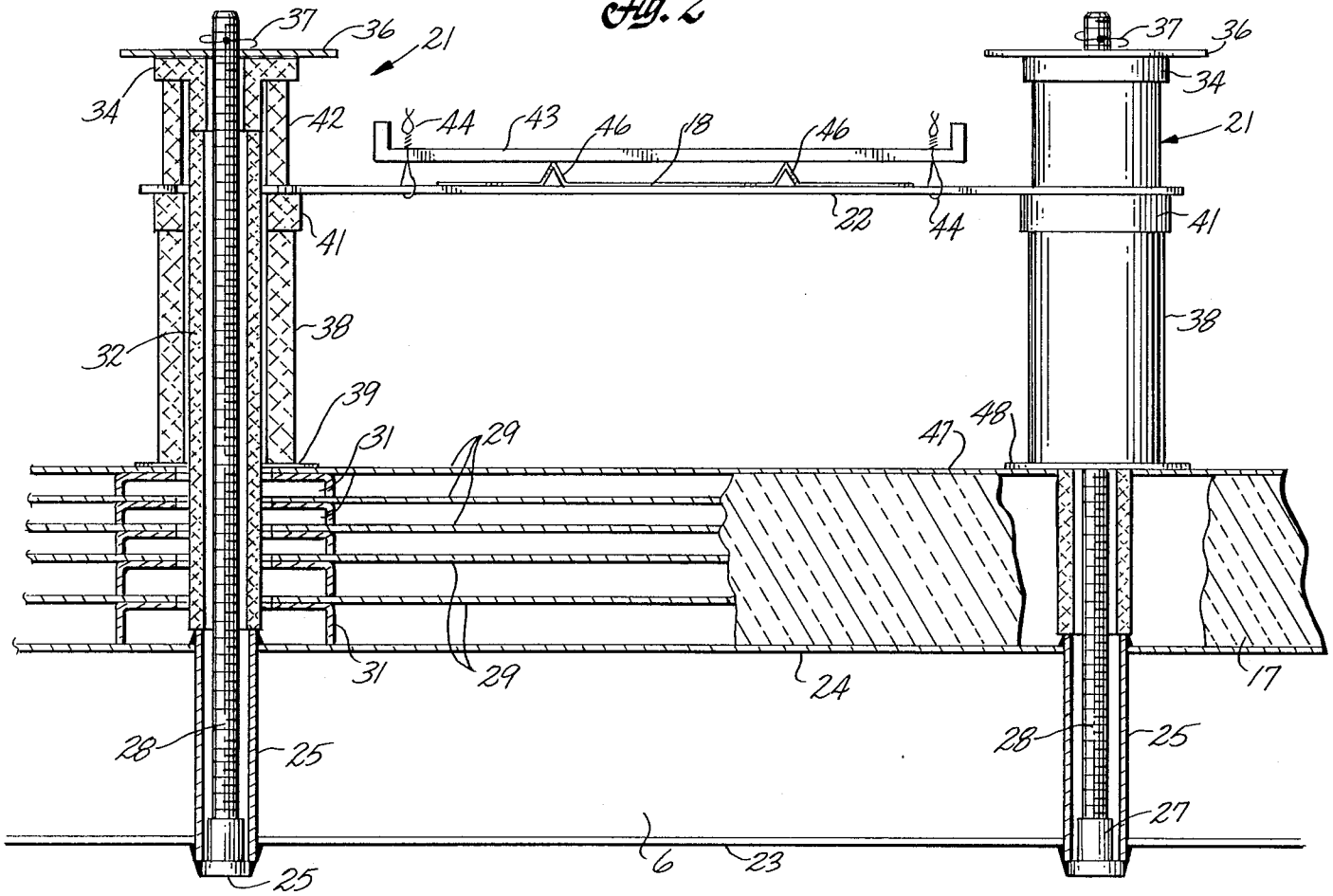
FIG. 2 is a view partly in cross-section and partly in elevation of a heater element support as provided in practice of this invention.

An exemplary heater support assembly is illustrated in FIG. 2. This view looks at such a support assembly circumferentially around the hot zone, that is, along the length of the heating element 18, which appears in transverse cross-section. The support assembly comprises two mounting assemblies 21 with a "bridge" 22 therebetween. In this drawing, one mounting assembly is illustrated in longitudinal cross-section, and the other is in elevation. Also in FIG. 2, two different types of thermal insulation are illustrated. Although different portions of the furnace may be insulated with each type of insulation, it is more typical for the same kind of insulation to be used throughout.

In the description of this embodiment, the portion of the support assembly that connects to the heating chamber is referred to as the bottom or lower portion. Similarly, the opposite end that extends toward the center of the heating chamber is referred to as the top or upper portion. This convention is adopted for ease of exposition and has nothing to do with the actual orientation of the support assembly in the furnace. It will be apparent that there are support assemblies all the way around the cylindrical heating chamber, and some of them could be regarded as being upside-down when compared with this description of the invention.

The plenum 16 around the heating chamber is formed by an outer sheet metal wall 23 and an inner sheet metal wall 24. Typically, these walls are stainless steel rolled into a cylinder. A stainless steel tube 25 extends through the plenum and is welded to the inner and outer plenum walls at the location of each mounting assembly. Additional spacers between the sheets may be employed, but other details of the plenum are not required for an understanding of this invention.

A stainless steel tee-nut is welded into the outer (or lower) end of the tube 25. A molybdenum rod or post 28 with roll formed threads is threaded into the tee-nut and extends inwardly (upwardly) toward the center of the furnace. Molybdenum is used for this and other structural elements because of its ability to withstand the elevated temperatures encountered in the vacuum furnace. Depending on the temperature requirements for the furnace, the various metal and ceramic parts may be fabricated of lower cost materials than the molybdenum, stainless steel and alumina mentioned herein.

One type of thermal insulation commonly employed in vacuum furnaces comprises a plurality of sheet metal radiation shields 29. In a vacuum radiation is the principal mechanism of heat transfer. A plurality of reflective radiation shields can be quite effective in providing a temperature gradient between the inner hot zone of the furnace and the surrounding shell. In an exemplary embodiment as illustrated in FIG. 2, five such radiation shields are employed inwardly of the plenum walls, which themselves act as radiation shields. At the location of the mounting assembly, U-shaped sheet metal spacers 31 keep the radiation shields spaced apart from each other. Three or four innermost radiation shields and spacers may be fabricated of molybdenum while the outer ones are safely fabricated of less expensive stainless steel.

The radiation shields and spacers each have a hole for providing ample clearance around a ceramic sleeve 32 around the molybdenum post 28 to permit shifting of the shields due to thermal expansion without applying undue loads on the mounting assembly. A high-temperature ceramic such as alumina is preferred. The lower end of the sleeve rests against the tube 25 through the plenum or the inner plenum wall 24.

A top hat shaped ceramic cap 34 has its "crown" resting on top of the inner sleeve. A molybdenum washer 36 overlies the larger flange or "brim" of the cap 34. A molybdenum wire 37 through a hole near the upper end of the molybdenum post 28 secures the washer 36 in place.

The wire can be used for rotating the post and threading it into the tee-nut 27 to put the post in slight tension and the ceramic sleeve 32 in slight compression. This holds the mounting assembly securely in place as differential thermal expansions occur.

It will be noted that of the parts making up the support assembly for the heater element, the top hat shaped cap is the only one that is not cut from readily available sheet, tube or bar stock. It may be desirable to order ceramic tubes precut to length or in standard lengths, but everything else is easily cut or bent to shape with simple tools or machines.

Surrounding the ceramic sleeve 32 is a lower ceramic outer tube 38, the lower end of which rests on a molybdenum washer 39 on top of the innermost radiation shield. A ceramic spacer 41 rests on top of the lower ceramic tube. The ceramic spacer has a larger outside diameter than the lower ceramic tube. An upper ceramic tube 42 has its upper end against the brim of the top hat shaped cap 34. The upper tube has a smaller diameter than the brim on the cap.

Generally speaking, it is desirable to employ ceramic tubes with relatively thin wall. This reduces the mass of material in the heating chamber to be heated and cooled, and also minimizes the possibility of thermal shock damage. To assure that there is adequate bearing area between the relatively small diameter tube and the end of the bridge, the ceramic spacer has a larger outside diameter than the ceramic tube. When the support assembly is mounted in the upper portion of the heating chamber so that the post extends downwardly from the wall of the heating chamber, it may be desirable to place the ceramic spacer between the "upper" tube and the end of the bridge to provide additional bearing area.

The different diameters of the brim and upper tube, and the spacer and lower tube provide discontinuities in the ceramic surface. The discontinunities tend to provide a break in any conductive path which might be established due to metallizing of the ceramic, thereby minimizing the potential for electrical shorts. By having the lower end of the inner sleeve extend through at least one of the radiation shields, there is no direct path for metallizing at this end of the insulator.

One end of the bridge 22 is positioned between the spacer 41 and the lower end of the upper tube 42. A hole through the bridge provides clearance around the inner ceramic sleeve 32, yet is smaller than the outside diameter of the tubes for support of the bridge. To accommodate thermal expansion, it is preferred to employ a circular hole at one end of the bridge and a slot at the opposite end. The assembly of radiation shields, tubes, etc. have a length suitable for holding the bridge in place without so severely clamping it that it would buckle due to thermal expansion. In other words, the support for the bridge is compliant and the end of the bridge with a slot can shift to accommodate thermal expansion without applying substantial additional load on the mounting assembly or deforming the bridge.

The bridge in a preferred embodiment, is a flat strip of molybdenum which in an exemplary embodiment, is 0.06 inch thick and an inch wide. Its length corresponds to the distance between the mounting assemblies, which distance is appropriate for the heater width in a given furnace. For example, the distance between mounting assemblies may be six inches for supporting a four inch wide heating element. Preferably the material for the bridge is the same as the heating element so that they both have the same thermal expansion.

The heating element 18 rests on top of the bridge. It is compliantly secured to the bridge by a molybdenum retaining rod 43 which has a length greater than the width of the heating element. Each end of the retaining rod has an L-shaped bend, and the rod is tied to the bridge by twisted loops of molybdenum wire 44 near each end. There are no holes in either the heating element or the bridge. In an exemplary embodiment, the heating element has two parallel V-shaped stiffening ridges bent into the sheet metal extending along its length. The retaining rod in such an embodiment lies atop the stiffening ridges. By loosely tieing the retaining rod to the bridge, the heating element is compliantly secured so that it can shift as required by thermal expansion.

The heating element is in good electrical contact with the support bridge. The ends of the bridge are, therefore, electrically insulated to prevent shorting to the metal structure of the heating chamber. The inner sleeve 32 provides electrical insulation between the molybdenum support post and the holes through the end of the bridge. The outer ceramic tubes supporting the ends of the bridge space it apart from other metal structures and provide electrical insulation therefrom.

By using separate insulating structures with differing diameters, and by keeping the joints between ceramic elements away from straight lines, electrical shorting due to metallizing can be avoided. Thus, for example, the top hat shaped cap has engagement with the inner sleeve at a different elevation from contact with the top of the upper tube. Since these two joints are not in line, metallized vapors (which travel in straight lines in a vacuum) cannot be deposited in locations that would cause electrical shorting. It will also be noted that metallizing of the inner sleeve is virtually nonexistent because of the surrounding ceramic tubes. The ends of the inner sleeve are also in the "shadow" of other structure such as the upper sleeve or the radiation shields so that there is no metallizing at the ends.

If desired, a vacuum furnace may be insulated with a ceramic "wool" or graphite felt or some combination of such thermal insulations surrounding the hearth, instead of with metal radiation shields. In an embodiment with ceramic wool insulation, as illustrated in FIG. 2, the connection of the mounting assembly to the plenum is similar. The inner ceramic sleeve 32 extends through the insulation wool 17, and its lower end bears against the tube 26 spacing the walls of the plenum apart from each other. The insulation is retained between the inner plenum wall 24 and a molybdenum sheet liner 47 corresponding approximately to the innermost radiation shield 29. A molybdenum washer 48 analogous to the washer 39 lies atop the insulation and tends to spread the load of the lower tube, if any, around a larger area.

Although limited embodiments of heater element supporting structure have been described and illustrated herein, many modifications and variations will be apparent to one skilled in the art.

Thus, for example, the bridge between the two mounting assemblies in the preferred embodiment is merely a flat sheet of molybdenum. If desired for added stiffness, the bridge may be bent to have a V shape or curved cross-section transverse to its length. Generally speaking, this is more costly than simply increasing the thickness of the modlybdenum to obtain a desired stiffness. It should also be remembered that molybdenum is embrittled upon heating to elevated temperatures and residual stresses in more complex shapes may be detrimental.

Further, molybdenum is not the only material for fabrication of the support assemblies and heater elements. Tantalum and tungsten are other exemplary high temperature materials. Analogous supports may be used for graphite or alloy heating elements as well.

In the illustrated embodiment, a single inner sleeve and two outer tubes are used. It will be apparent that these can be assembled out of shorter tubes or rings. It is desirable, however, to minimize the number of parts needed in any assembly.

For such reasons, it is to be understood that within the scope of the appended claims, this invention may be practiced otherwise than as specifically described.

We claim:

1. A mechanical support for an intermediate portion of an electric heater element in a furnace comprising:
- a pair of spaced apart mounting assemblies;
- a rigid metal bridge between the mounting assemblies electrically insulated from any metal parts of the mounting assemblies and sufficiently compliantly connected to at least one of the mounting assemblies for accommodating thermal expansion of the bridge without substantial deformation; and
- means for compliantly securing a heater strip to the bridge without holes in the heater strip, the heater strip and metal bridge being of the same metal.

2. A mechanical support for an intermediate portion of an electric heater element in a furnace comprising:
- a pair of spaced apart mounting assemblies comprising:
  - a metal post;
  - a ceramic sleeve surrounding the metal post;
  - an upper ceramic tube and a lower ceramic tube around the sleeve for holding an end of a bridge therebetween; and
  - means for securing the post in the heating chamber of the furnace;
- a rigid bridge between the mounting assemblies electrically insulated from any metal parts of the mounting assemblies and sufficiently compliantly connected to at least one of the mounting assemblies for accommodating thermal expansion of the bridge without substantial deformation; and
- means for compliantly securing a heater strip to the bridge without holes in the heater strip.

3. A support as recited in claim 2 wherein the bridge comprises a metal strip between the two mounting assemblies, each end of the strip having a hole smaller than the outside diameter of the tubes and larger than the outside diameter of the sleeve.

4. A support as recited in claim 3 wherein one of the holes in the strip is a slot for accommodating thermal expansion of the strip.

5. A support as recited in claim 3 wherein the metal strip is the same material as the heater element.

6. A support as recited in claim 2 wherein each mounting assembly comprises a hollow top hat shaped ceramic cap around the upper end of the post for engaging the end of the sleeve with the crown of the cap and the end of the upper tube with the brim of the cap.

7. A support as recited in claim 2 wherein the post of each mounting assembly extends through a plurality of metal radiation shields and the end of the lower tube bears against an upper radiation shield.

8. A support as recited in claim 7 wherein each mounting assembly comprises a plurality of generally U-shaped spacers between adjacent radiation shields.

9. A support as recited in claim 7 wherein the sleeve extends through at least one such radiation shield.

10. A mechanical support for an intermediate portion of an electric heater element in a furnace comprising:
- a pair of spaced apart mounting assemblies;
- a rigid bridge between the mounting assemblies electrically insulated from any metal parts of the mounting assemblies and sufficiently compliantly connected to at least one of the mounting assemblies for accommodating thermal expansion of the bridge without substantial deformation; and
- means for compliantly securing a heater strip to the bridge without holes in the heater strip; and wherein each mounting assembly comprises:
  - a metal post;
  - a ceramic sleeve surrounding the post;
  - an upper ceramic tube and a lower ceramic tube around the sleeve, an end of the bridge being between the tubes;
  - a hollow ceramic cap engaging the upper end of the sleeve and the upper end of the upper tube; and means on the post engaging the cap for holding the mounting assembly together; and wherein
  - the bridge has a hole at each end, the sleeve of such a mounting assembly passing through a respective hole, the hole being smaller than the outside diameter of the tubes.

11. A support as recited in claim 10 wherein the hollow cap comprises a top hat shaped ceramic cap around the upper end of the post for engaging the end of the sleeve with the crown of the cap and the end of the upper tube with the brim of the cap.

12. A vacuum furnace comprising:
- a furnace shell;
- a heating chamber in the furnace shell;
- at least one metal strip heater element in the heating chamber of the furnace;
- means for making electrical contact with each end of such a heater element for passing electric current therethrough; and
- at least one mechanical support for an intermediate portion of such an electric heater element comprising:
  - a pair of spaced apart mounting assemblies connected to the heating chamber;
  - a metal bridge between the mounting assemblies electrically insulated from any metal parts of the mounting assemblies and sufficiently compliantly connected to at least one of the mounting assemblies for accommodating thermal expansion of the bridge without substantial deformation; and
  - means for compliantly securing the heater element on the bridge.

13. A furnace as recited in claim 12 wherein each mounting assembly comprises:
- a metal post connected to the heating chamber;

a ceramic sleeve surrounding the metal post; and an upper ceramic tube and a lower ceramic tube around the sleeve and holding an end of the bridge therebetween.

14. A support as recited in claim 13 wherein each mounting assembly comprises a hollow top hat shaped ceramic cap around the upper end of the post for engaging the end of the sleeve with the crown of the cap and the end of the upper tube with the brim of the cap.

15. A support as recited in claim 13 wherein the metal bridge has a hole at one end of the bridge smaller than the outside diameter of the tubes and fitted around such a sleeve, and a slot at the other end of the bridge narrower than the outside diameter of the tubes and fitted around such a sleeve for accommodating thermal expansion of the bridge.

16. A support as recited in claim 12 wherein the metal bridge is the same material as the heater element.

17. A support as recited in claim 12 wherein each mounting assembly comprises:

a metal post;

a ceramic sleeve surrounding the post;

an upper ceramic tube and a lower ceramic tube around the sleeve, an end of the bridge being between the tubes;

a hollow ceramic cap engaging the upper end of the sleeve and the upper end of the upper tube; and means on the post engaging the cap for holding the mounting assembly together; and wherein the bridge has a hole at each end, the sleeve of such a mounting assembly passing through a respective hole, the hole being smaller than the outside diameter of the tubes.

* * * * *